United States Patent [19]

Marshall, Jr. et al.

[11] 4,360,946

[45] Nov. 30, 1982

[54] APPARATUS FOR CLEANING FLOORS AND FLOOR COVERINGS

[75] Inventors: Irl H. Marshall, Jr., Northbrook; Paul R. Bald, Hoffman Estates, both of Ill.

[73] Assignee: Duraclean International, Deerfield, Ill.

[21] Appl. No.: 145,345

[22] Filed: Apr. 30, 1980

[51] Int. Cl.[3] ..... A47L 7/00

[52] U.S. Cl. ..... 15/321; 15/353; 15/354

[58] Field of Search ..... 15/320, 321, 322, 50 R, 15/50 A, 50 C, 354

[56] References Cited

U.S. PATENT DOCUMENTS

| | | | |
|---|---|---|---|
| 1,596,041 | 8/1926 | Young | 15/50 C X |
| 2,292,435 | 8/1942 | Crites | 15/50 C X |
| 3,784,111 | 1/1974 | Piggott | 239/427.3 |
| 4,167,799 | 9/1979 | Webb | 15/320 |

*Primary Examiner*—Chris K. Moore

*Attorney, Agent, or Firm*—Hume, Clement, Brinks, Willian & Olds, Ltd.

[57] ABSTRACT

A floor cleaning apparatus, particularly adapted to clean carpet, is disclosed. A rotatably mounted brush extends in a transverse direction substantially parallel to the floor. The apparatus has front and back ends with a plurality of foam-producing nozzles mounted to the rear of the brush, the nozzles being positioned to spray foam into the brush, so that rotation of the brush causes the foam to be brushed into the floor. Vacuum means are also included which have a downwardly directed intake extending transversely across the apparatus, the intake being positioned forward of the brush so that rearward movement of the apparatus causes the vacuum means to remove foam and released dirt from the floor.

5 Claims, 5 Drawing Figures

FIG. 3
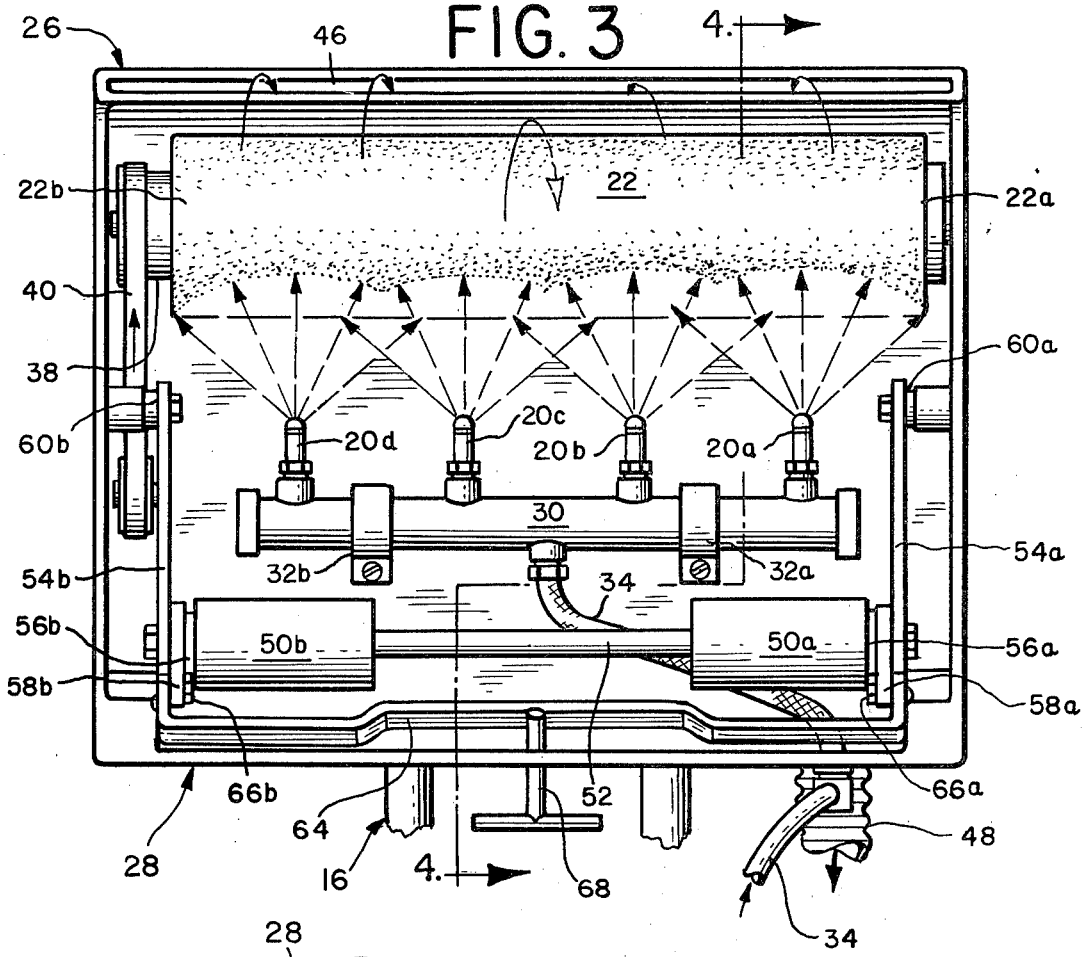
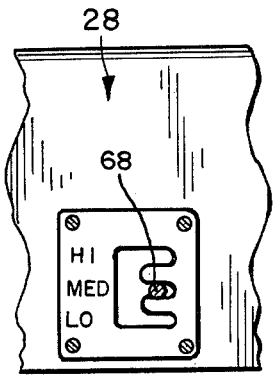
FIG. 5
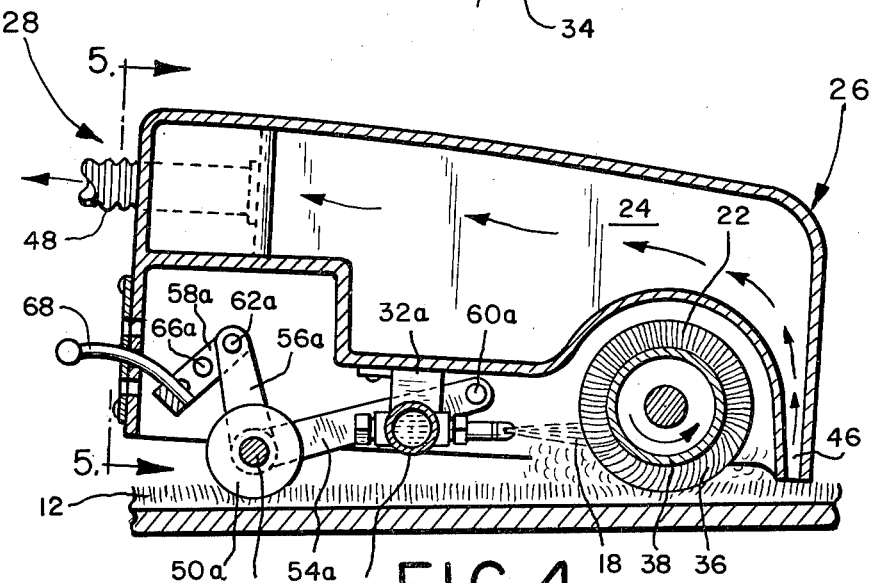
FIG. 4

APPARATUS FOR CLEANING FLOORS AND FLOOR COVERINGS

BACKGROUND AND SUMMARY OF THE INVENTION

This invention relates to an apparatus for cleaning floors and floor coverings. More particularly, the invention relates to an apparatus adapted for the cleaning of carpets through the use of foam cleaning agents.

Foam cleaning agents have been used to clean carpets for many years. While it is possible to perform foam cleaning operations manually, it takes less physical exertion and therefore is normally preferable to utilize an apparatus which will assure even application and removal of the foam, and at the same time provide means for vigorously agitating the carpet prior to removal of the foam, thus providing superior cleansing. Such apparatus have also attempted to remove the foam as soon as possible after application to prevent oversaturation of the carpet which can result in shrinkage, browning, mildew and excessive drying times. Due to difficulties inherent in conveying foam through closed conduits, such apparatus also include means for generating the foam.

Many such designs have been introduced. For example, U.S. Pat. No. 3,392,418 to Schowalter discloses a self-contained unit in which foam is generated through the utilization of a high pressure air stream acting upon a detergent feed tube. The air conveys droplets of detergent against a screen, thereby producing foam. The foam is permitted to drop downwardly, through slots, onto a cylindrical brush. The brush is disposed transversely across the apparatus, parallel to the floor, so that rotation of the brush conveys foam to the carpet and agitates the carpet. The foam is subsequently removed by one of two vacuum slots positioned to the front and rear of the brush.

There are several drawbacks with Schowalter's design. First, Schowalter requires means for generating pressurized air. Such means are heavy and bulky, include serious disadvantages when one goal is to provide a self-contained, easily maneuverable apparatus, and will add substantially to the cost of the unit. However, a second, more important, disadvantage of the use of pressurized air to generate foam is that the foam itself is of lower quality for cleaning purposes. The use of pressurized air results in a foam which is very light (a high air/liquid ratio). This minimizes the amount of cleaning fluid in the foam, and thereby decreases the effective cleansing achieved by the foam. Moreover, due to the light weight of the foam, there is a minimal amount of penetration into the carpet, thus resulting in only surface cleaning. In addition to the problems inherent in the use of light weight foam such as that generated by Schowalter's apparatus, foam formed through the use of pressurized air is often irregular in consistency. This introduces the possibility of streaking due to uneven saturation and cleaning of the carpet. This possibility of streaking is further advanced by yet another design flaw in Schowalter's apparatus, to wit, the fact that he utilizes a plurality of spaced slots to generate the foam and deposit it on the brush, thus necessarily relying upon the brush itself to evenly distribute the foam across its length. Since the brush only rotates and does not move axially, only a minimal amount of axial distribution takes place in the brush.

Due to the above-described problems in the generation and application of foam to the carpet, others have designed apparatus which use liquid cleaning agents. These apparatus are often referred to in the industry as "steam" cleaners. For example, U.S. Pat. No. 1,975,380 to Streich discloses an apparatus in which two nozzles spray liquid cleaner into a transversely disposed rotating brush. Streich's brush is intended to convey the liquid to the carpet, and agitate the carpet prior to removal of the liquid by transverse vacuum means. Streich's design results in the uneven distribution of cleaning liquid because his liquid would have a tendency to penetrate into the brush, saturating the brush after a certain period of time which could result in drainage from the brush to the carpet. This could produce serious streaking and overwetting problems.

This problem of overwetting, briefly mentioned above, is one which is inherent in all liquid (so-called "steam") cleaning operations. When cleaning liquid is brushed, sprayed, or otherwise deposited on the carpet, it tends to penetrate deeply into the carpet. While theoretically this could result in excellent deep cleaning action, liquid cleaning operations have a serious practical problem in that once the cleaning liquid has penetrated into the carpet, it is extremely difficult, if not impossible, to remove. Moreover, in passing through the upper layers of fibers, the liquid tends to absorb dirt and carry it down to the lower layers, where it remains. This minimizes the amount of dirt which can actually be removed from the carpet, and can result in shrinkage, mildew and browning. Moreover, all liquid (or steam) cleaning operations require substantial drying times, which is a serious disadvantage, particularly in commercial establishments.

A more recent U.S. Pat. No. 3,699,607, to Putt, utilizes a plurality of aligned nozzles to spray liquid cleaner (which the patent says is water) toward the floor near the engagement of a transversely disposed brush with the floor. Because Putt sprays the liquid cleaner toward the floor, his design could produce overwetting problems even more serious than those encountered by Streich.

It is thus an object of the present invention to provide an apparatus for cleaning carpets utilizing foam in order to overcome the aforementioned disadvantages inherent in the use of liquid cleaners. Another object is the provision of an apparatus for cleaning floor coverings which generates a dense, uniform quality foam, in order to achieve controlled penetration, superior cleansing, and which can remove the dirt-laden foam after a brief period of contact with the floor covering, thereby minimizing the possibility of overwetting. Yet another object of the present invention is to provide an apparatus which can deposit cleansing foam on a floor covering in an even pattern, and at the same time agitate the floor covering in order to ensure even, complete cleaning of the floor covering and to minimize streaking.

This invention responds to the drawbacks and limitations of the prior art by providing an apparatus which utilizes a transversely extending brush in conjunction with a plurality of foam producing nozzles which direct a spray of foam toward the brush, and vacuum means adapted to remove the foam and released dirt from the floor covering. The brush is rotatably mounted and is adapted to contact the floor covering when the apparatus is in its operating position. The apparatus includes front and back ends and the nozzles are positioned to the rear of the brush, to spray foam into the brush in a direction which is substantially parallel with the floor. Thus, rotation of the brush causes the foam to be brushed into the floor covering. The vacuum means include an intake extending transversely across the apparatus, forward of the brush, so that rearward movement of the apparatus permits the vacuum means intake to remove foam and released dirt from the floor covering. The nozzles are positioned such that the spray from each nozzle overlaps the spray from an adjacent nozzle. The spray patterns can be arranged such that the spray from each nozzle overlaps the proximal half of the spray from an adjacent nozzle, thereby ensuring double coverage of foam for substantially the entire length of the brush.

These and other features and advantages of the present invention will be apparent from the following description, appended claims and annexed drawings.

BRIEF DESCRIPTION OF THE DRAWINGS

FIG. 3 is a view of the underside of the invention;

FIG. 4 is a sectional elevation view taken along line 4—4 of FIG. 3; and FIG. 5 is a partially-sectioned elevation view taken along line 5—5 of FIG. 4, showing a mechanism for controlling the height of the apparatus with respect to the floor.

DETAILED DESCRIPTION OF THE PREFERRED EMBODIMENTS

Figures 1, 2:
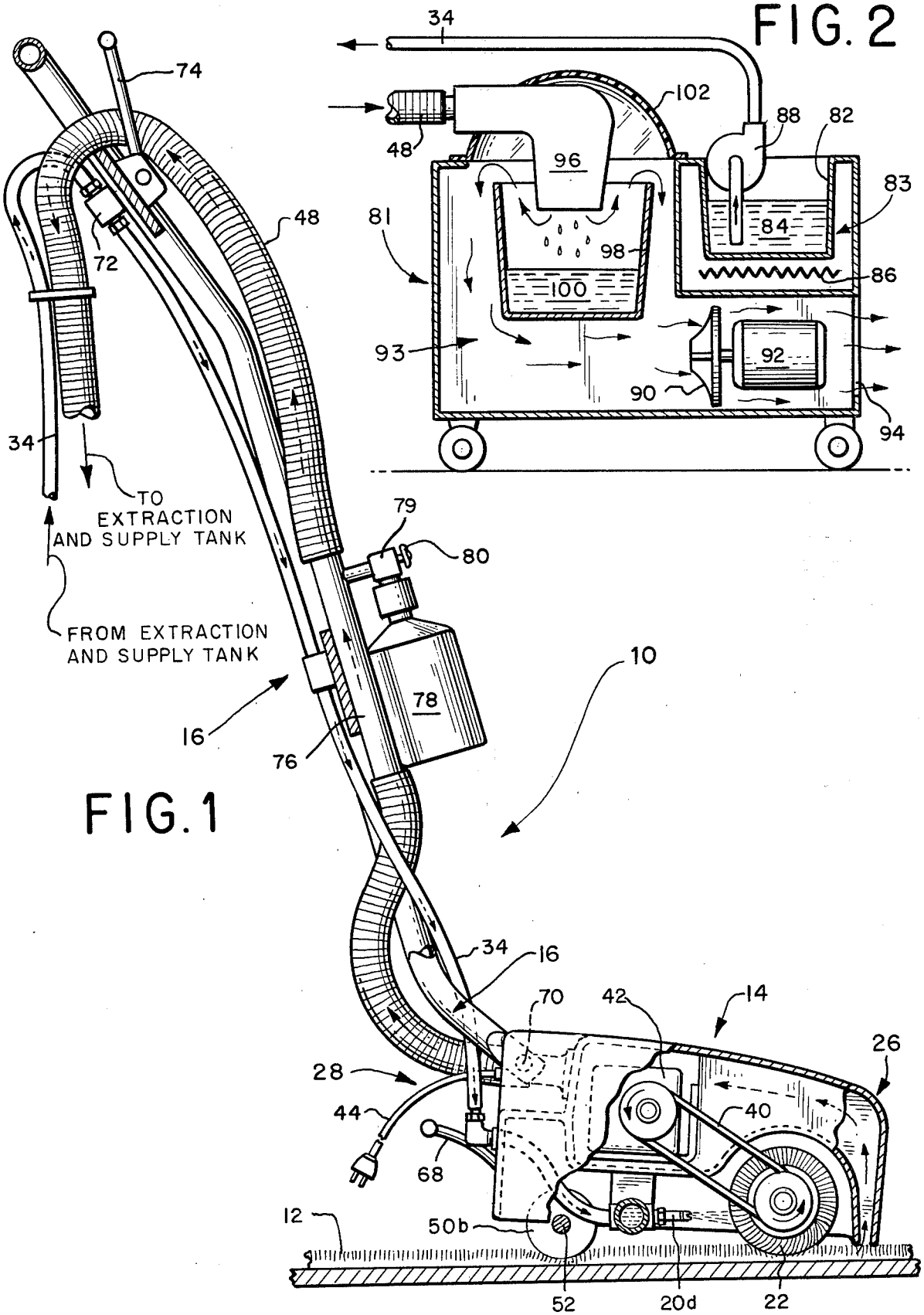
FIG. 1 is a partially-sectioned elevation view of one embodiment of the invention.
FIG. 2 is a schematic representation of an auxiliary machine that may be used in conjunction with the invention.

The principles of this invention are particularly useful when embodied in a floor cleaning apparatus such as that illustrated in the Figures, generally indicated by the numeral 10. While FIGS. 1 and 4 depict the apparatus to be cleaning carpet 12, it should be understood that the invention may be adapted to clean other types of floor coverings.

The apparatus 10 includes an applicator 14 and an operating handle 16. The applicator 14 is designed to apply a cleansing foam 18 to the carpet 12 and subsequently remove the foam 18 with the dirt released through the cleaning operation. The operating handle 16, of course, is for the operator to control the performance of the applicator 14.

Retained within the applicator 14 are a plurality of foam-producing nozzles 20*a–d*, transversely mounted brush 22, and a vacuum duct 24. The applicator 14 includes front and rear ends 26 and 28, respectively. Thus, FIGS. 1 and 4 illustrate that the nozzles 20*a–d* are positioned to the rear of the brush 22, which is below and to the rear of the vacuum duct 24.

As shown best in FIG. 3, the depicted embodiment includes four foam-producing nozzles 20*a*, 20*b*, 20*c* and 20*d*. They are transversely aligned and equally spaced in order to ensure even distribution of foam 18 on the brush 22. FIG. 3 depicts how the spray pattern from each nozzle 20*a–d* overlaps the proximal half of the spray pattern from the adjacent nozzle, thereby providing double coverage of foam 18 across most of the length of the brush 22.

Liquid foam-producing agent is provided to the nozzles 20*a–d* by a common conduit 30. The conduit 30 also rigidly supports the nozzles 20*a–d* because it, in turn, is rigidly mounted to the frame of the applicator 14 by two brackets 32*a* and 32*b*. Alternatively, it may be desirable in some applications that the conduit 30 be adjustable with respect to the applicator so that the distance between the nozzles and the brush may be varied. In any event, the liquid foam-producing agent is provided by a flexible supply tube 34 which extends out the applicator 14 and up the operating handle 16 as will be described more fully hereinbelow.

The nozzles 20*a–d* are of the naturally-aspirated type. That is, the flow of liquid foam-producing agent through each nozzle causes a reduction of pressure within the nozzle, thereby naturally aspirating air into the nozzle through suitable aperatures (not shown). Each of the nozzles 20*a–d* generates a wide, flat spray of foam 18. One such nozzle is depicted and described in U.S. Pat. No. 3,784,111 to Piggott. However, the preferred design is that disclosed in detail in a patent application filed on the same day as the present application, identified by Ser. No. 145,344, entitled Nozzle and Method for Generating Foam, assigned to the assignee of the present application. This preferred design of nozzle is not depicted herein because it is not a part of the present invention. However, it will be described briefly.

The preferred nozzle includes centrally mounted, circular orifice adjacent its inlet end. Sufficient input pressure is provided so that the orifice produces a circularly cross-sectioned high velocity stream of liquid foam-producing agent through the nozzle, thus reducing the pressure within the nozzle. Two radially spaced apertures in the sides of the nozzle walls permit air to be drawn into the nozzle, due to the fact that atmospheric pressure exists outside of the nozzle, and the pressure is less than atmospheric within the nozzle. The high velocity stream of foam-producing agent is then impinged against a circularly cross-sectioned impingement pin disposed transversely within the nozzle, in the path of the stream of foam-producing agent. Impingement of the stream against the impingement pin results in disruption of the flow of the stream, and splits the stream into two secondary streams which diverge outwardly with respect to each other. These secondary streams then impinge inwardly off the inner walls of the nozzle and converge in the vicinity of a transverse discharge slot, disposed parallel to the impingement pin. Upon convergence of these secondary streams, the foam-producing agent is fully aerated, thus ensuring a wide, flat spray of uniform quality foam.

The use of naturally-aspirated nozzles such as that described provides a dense, uniform foam which permits controlled penetration and excellent dirt retention, thereby facilitating a high degree of dirt removal from the carpet or other floor covering.

The brush 22 is generally cylindrical in shape, and extends substantially the entire width of the applicator 14. The brush bristles 36 are preferably formed of polyester fiber, and should be sufficiently stiff to vigorously agitate but not damage the carpet 12.

The brush bristles 36 are mounted to a cylindrical brush body 38 which is rotatably mounted at its ends (not shown) to the frame of the applicator 14. A brush drive belt 40 is mounted adjacent to one end of the brush body 38. This brush drive belt 40 is also connected to a drive motor 42 which provides rotational power to the brush 22. Electrical power for the drive motor 42 is provided by an electrical supply cord 44. Of course, the drive motor 42, the supply cord 44 and the brush drive belt 40 should all be isolated from the portions of the applicator 14 which receive or are in substantial contact with the cleansing foam 18 in order to prevent damage to the elements of the apparatus 10 and possible electrical injury to the operator.

The vacuum duct 24 includes an intake slot 46 which extends substantially the entire width of the applicator 14. The intake slot 46 is positioned immediately forward of the brush 22, and is preferably in direct contact with the carpet 12 when the applicator 14 is in its operating position. A partial vacuum is induced into the vacuum duct 24 and the intake slot 46 through a flexible extraction tube 48 which extends from the vacuum duct 24 and up the operating handle 16 as will be described more fully hereinbelow.

The applicator 14 includes axially aligned support rollers 50*a* and *b* which are rotatably mounted on a common support roller shaft 52 for supporting the applicator 14 above the carpet 12. These support rollers 50 are preferably of substantial width in order to minimize the formation of even temporary indentations in the carpet 12.

It is desirable that the height of the applicator 14 above the carpet 12 be adjustable to ensure optimum performance for a wide variety of floor coverings. The means for adjustment depicted in FIG. 4 comprise a double system for stability, one on each side of the applicator 14. The means are conventional in design and include forward, mid and rear lever arms 54*a* and *b*, 56*a* and *b*, and 58*a* and *b*. The forward lever arms 54*a* and 54*b* are each pivotally mounted between a forward fulcrum 60*a* or 60*b* and the support roller shaft 52. The mid lever arms 56*a* and 56*b* are each pivotally mounted between the support roller shaft 52 and a link 62*a* or 62*b* with rear lever arm 58*a* or 58*b*. The rear lever arms 58*a* and 58*b* each extends between the link 62*a* or 62*b* with mid lever arm 56*a* or 56*b*, and one end of a transversely extending adjustment member 64. The rear lever arms 58*a* and 58*b* are each pivotally mounted to a rear fulcrum 66*a* or 66*b*. Connected to the transversely extending adjustment member 64 is a position control lever 68. This lever enables the operator, through the linkage described above, to vary the position of the support rollers 50*a* and *b*, and thereby adapt the applicator 14 for operation with a wide variety of carpets and other floor coverings.

As depicted in FIG. 1, the operating handle 16 is mounted to the rear end 28 of the applicator 14 at pivot point 70. Means are also provided for temporarily fixing the position of the operating handle 16 with respect to the applicator 14 so that the operator can tilt the front end 26 of the applicator upward to roll it forward. However, such means would be of conventional design and therefore are not depicted.

Both the supply tube 34 and the extraction tube 48 are shown to wrap around the operating handle 16 to ease handling of the apparatus 10. A liquid control valve 72 is provided in the supply tube 34 with a control lever 74 to permit the operator to regulate the amount of liquid foam-producing agent being sent to the nozzles 20*a–d* within the applicator 14. In some applications the liquid control valve 72 need only have the capability to open and close the supply tube 34. However, it is normally desirable that the liquid control valve 72 have the capability of accurately metering the flow of liquid foam-producing agent to the nozzles 20*a–b* in order to take full advantage of the features of the present invention. In any event, the liquid control valve 72 is of conventional design so will not be described in detail.

The control lever 74 includes an electrical switch (not shown) and is electrically connected to the drive motor 42. This feature is provided so that the brush 22 is activated when the liquid control valve 72 is opened and foam 18 begins to pass from the nozzles 20*a–d*.

The extraction tube 48 preferably includes a rigid tube 76 which is affixed to the operating handle 16. A defoamant bottle 78 is mounted to the tube 76 and includes a manually operable dispenser valve 79 with a wing-type control nut 80 designed to control the flow of fluid out of the defoamant bottle 78. The defoamant bottle 78 is filled with a defoaming agent which, upon contact with dirty foam leaving the applicator 14, reduces the foam to liquid, thereby preventing foam overflow from the extraction reservoir 98, which is described below. The induced vacuum from the extraction tube 48 pulls the defoaming agent out of the defoamant bottle 78 so a supplemental feed means is not required. The dispenser valve control nut 80 enables the operator to manually control the rate of flow from the defoamant bottle 78.

The extraction and supply tank 81 depicted schematically in FIG. 2 will now be described. It is of conventional design and is designed (1) to provide a regular flow of liquid foam-producing agent, under pressure, to the cleaning apparatus 10, and (2) to induce a partial vacuum in the vacuum duct 24. This extraction and supply tank 81 has the capability of separating dirty liquid droplets (which remain after the defoaming agent acts on the dirty foam) from the air which has been taken in through the vacuum intake slot 46 along with the dirty foam.

The extraction and supply tank 81 includes a supply reservoir 82 which is positioned within the supply portion 83 of the tank and is adapted to retain an adequate supply of liquid foam-producing agent 84. Heating means such as a coil (indicated schematically at 86) is provided below the supply reservoir 82 to preheat the liquid foam-producing agent 84 to the desired temperature. A supply pump 88 is provided in the vicinity of the supply reservoir 82 for pumping liquid foam-producing agent 84 to the nozzles 20*a–d* within the applicator 14. The supply pump 88 should have the capability of providing approximately at least 35 p.s.i.g. of pressure at the nozzles 20*a–d*.

A suction blower 90 with a motor 92 is provided within the extraction portion 93 of the extraction and supply tank 81 to induce a partial vacuum within the extraction tube 48. An exhaust port 94 is provided in a side wall of the extraction portion 93, but this is the only opening to the atmosphere within the extraction portion 93. An oversized separation chamber 96 leads the extraction tube 48 into the extraction portion 93. An extraction reservoir 98 is positioned below the separation chamber 96 in order to receive droplets of dirty liquid 100. These droplets are permitted to fall by gravity into the extraction reservoir 98, while the air escapes over the edges of the extraction reservoir 98 and passes out the exhaust port 94. The extraction reservoir 98 should be removable so that the operator can dump it when it is full. A transparent inspection dome 102 is provided in the depicted embodiment so that the operator can monitor the level in the extraction reservoir 98.

The operation of the apparatus 10 and the extraction and supply tank 81 will now be described. The applicator 14 should first be set to the proper height through the use of the position control lever 68. Prior to energization, the operator should also make sure that a sufficient amount of liquid foam-producing agent 84 and defoaming agent are retained within the supply reservoir 82 and the defoamant bottle 78, respectively. The extraction reservoir 98 should be empty.

Once the above conditions have been monitored, power can be provided to the suction motor 92, the supply pump 88 and the brush drive motor 42. The front end 26 of the applicator 14 is tilted upward, and the apparatus 10 is pushed forward to the end of the room to be cleaned. The control lever 74 can then be manipulated to open the liquid control valve 72 to the desired setting and activate the drive motor 42, thereby initiating rotation of the brush 22. The opening of the liquid control valve 72 permits liquid foam-producing agent to be pumped through the supply tube 34 to the conduit 30 and into the foam-producing nozzles 20*a–d*.

The passage of the liquid through the foam-producing nozzles 20*a–d* aspirates air into the nozzles. Subsequent impingement of the foam-producing agent within the nozzles 20*a–d* fully aerates the agent, thus resulting in the creation of a dense, uniform cleansing foam. The cleansing foam is discharged from the foam-producing nozzles 20*a–d* toward the brush 22 in a flat, fan-shaped spray 18. The spray patterns overlap to ensure double coverage of substantially the entire length of the brush 22. In guiding the apparatus 10 across the floor to be cleaned, the operator will provide a slight overlap of cleaning paths, thereby ensuring that the entire floor surface will obtain double coverage of foam.

The rotation of the brush 22 conveys the foam 18 downwardly into the carpet 12 which is agitated by the brush 22. This agitation also serves to enhance foaming. Since the foam 18 is of uniform density, and it is distributed across the entire length of the brush 22, streaking will be eliminated. Moreover, since the foam 18 produced by the nozzles 20*a–d* is more dense than the foam utilized in conventional foam carpet cleaners, it provides superior cleaning due to a higher application rate (in gallons per minute). It also achieves deeper cleaning than conventional light foams which typically only provide surface cleaning. The rotation of the brush 22 also acts to propel the applicator 14 in a rearward direction, with the speed of propulsion being controlled by the amount of pull applied on the operating handle 16 by the operator.

The rearward movement of the applicator 14 brings the vacuum intake slot 46 into contact with previously cleaned but foam-laden carpet. The partial vacuum induced through the extraction tube 48 by the suction blower removes the foam and the dirt retained therein. Since the intake slot 46 extends across the entire width of the applicator 14, no part of the foam-laden carpet will be missed. The use of dense foam 18 rather than a liquid cleaner of some other designs permits a very high removal rate due to the enhanced suction-removal characteristics of foam. This minimizes the amount of dirty cleansing agent remaining in the carpet 12.

Upon passing through the intake slot 46, the dirty foam travels through the vacuum duct 24 and into the extraction tube 48. The suction on the defoamant bottle 78 causes defoaming agent to be aspirated into the extraction tube 48, thus mixing with the dirty foam and reducing it to liquid. This dirty liquid passes into the extraction portion 93 of the extraction and supply tank 81, where the liquid 100 drops into the extraction reservoir 98 and the air passes over the edges of the extraction reservoir 98 and out the exhaust port 94.

The operator continues to monitor and control the rearward movement of the applicator 14 across the room to be cleaned. When the end of the room is reached, the control lever 74 is released and the front end 26 of the applicator 14 is tilted upward. The operator then rolls the apparatus 10 to the side and forward and begins a new pass. During this and subsequent passes, the operator slightly overlaps the previous pass, thereby ensuring double foam coverage for the entire floor surface. By passing over the carpet 12 in the described rearward direction, the operator need not walk over an area which has just been cleaned.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered in the following claims.

We claim:

1. A floor cleaning apparatus having front and back ends and comprising:
   - a rotatably mounted, transversely extending brush having an axis which is substantially parallel to the floor;
   - means for rotating said brush;
   - vacuum means with a downwardly directed intake extending substantially the entire width of said brush, said intake being positioned forward of said brush;
   - a plurality of foam-producing nozzles positioned to the rear of said brush, each of said nozzles being adapted to generate a flat spray of foam, said nozzles positioned to spray foam toward the axis of said brush so that rotation of said brush causes the foam to be conveyed to the floor, and said nozzles aligned such that the spray from each nozzle overlaps the spray from an adjacent nozzle.

2. The apparatus of claim 1, wherein said apparatus is particularly adapted to clean carpeting, and said vacuum means intake is adapted to contact the carpeting when said apparatus is operating so that a substantial portion of the foam which has been conveyed into the carpet by said brush will be removed by said vacuum means intake.

3. A floor cleaning apparatus having front and back ends and comprising:
   - a rotatably mounted, transversely extending brush having an axis which is substantially parallel to the floor;
   - means for rotating said brush;
   - vacuum means with a downwardly directed intake extending substantially the entire width of said brush, said intake being positioned forward of said brush;
   - a plurality of foam-producing nozzles positioned to the rear of said brush, each of said nozzles being adapted to generate a wide, flat spray of foam, said nozzles positioned to spray foam toward the axis of said brush so that rotation of said brush causes the foam to be conveyed to the floor, and will agitate the floor, whereby movement of said apparatus in rearward direction will cause said vacuum intake to remove foam and release dirt from the floor, each of said nozzles being aligned and positioned such that the spray from each nozzle overlaps the proximal half of the spray from the adjacent nozzle, thereby ensuring double coverage of foam for substantially the entire length of said brush.

4. A floor cleaning apparatus, particularly adapted to clean carpet, having front and back ends and comprising:

a transversely mounted brush adapted to contact the carpet when the apparatus is in its operating position;

means for rotating said brush;

a plurality of aligned, foam-producing nozzles positioned to the rear of said brush, said nozzles positioned to spray foam into said brush in a direction which is substantially parallel with the carpet so that rotation of said brush will cause the foam to be brushed into the carpet, and said nozzles aligned such that the spray from each nozzle overlaps the spray from an adjacent nozzle; and vacuum means with an intake slot positioned adjacent the carpet when the apparatus is in its operating position, and forward of said brush, said intake slot extending transversely across said apparatus having length at least substantially as great as the width of the foam spray generated by said nozzles so that rearward movement of said apparatus causes said vacuum means intake slot to remove foam and released dirt from the carpet.

5. A floor cleaning apparatus, particularly adapted to clean carpet, having front and back ends and comprising:

a transversely mounted brush adapted to contact the carpet when the apparatus is in its operating position;

means for rotating said brush;

a plurality of aligned, foam-producing nozzles positioned to the rear of said brush to spray foam into said brush in a direction which is substantially parallel with the carpet so that rotation of said brush will cause the foam to be brushed into the carpet, said nozzles aligned such that the spray from each nozzle overlaps the proximal half of the spray from an adjacent nozzle; and vacuum means with an intake slot positioned adjacent the carpet when the apparatus is in its operating position, and forward of said brush, said intake slot extending transversely across said apparatus so that rearward movement of said apparatus causes said vacuum means intake slot to remove foam and released dirt from the carpet.

* * * * *

UNITED STATES PATENT AND TRADEMARK OFFICE

CERTIFICATE OF CORRECTION

PATENT NO. : 4,360,946

DATED : November 30, 1982

INVENTOR(S) : Irl H. Marshall, Jr.
Paul R. Bald

It is certified that error appears in the above-identified patent and that said Letters Patent is hereby corrected as shown below:

Column 5, line 35, delete "extends" and substitute therefor --extend--;

Column 5, line 65, delete "20a-b" and substitute therefor --20a-d--;

Column 7, line 66, delete "100" and retype 100 in bold numbers.

Signed and Sealed this

*Seventh* Day of *June 1983*

[SEAL]

*Attest:*

DONALD J. QUIGG

*Attesting Officer*

*Acting Commissioner of Patents and Trademarks*